US005215683A

United States Patent [19]

Kravetz et al.

[11] Patent Number: 5,215,683

[45] Date of Patent: * Jun. 1, 1993

[54] HIGHLY CONCENTRATED LIQUID SURFACE ACTIVE COMPOSITIONS CONTAINING ALCOHOL ETHOXYLATE AND ALCOHOL ETHOXYSULFATE

[75] Inventors: Louis Kravetz, Houston; Kirk H. Raney, Sugar Land, both of Tex.

[73] Assignee: Shell Oil Company, Houston, Tex.

[ * ] Notice: The portion of the term of this patent subsequent to May 11, 2010 has been disclaimed.

[21] Appl. No.: 887,571

[22] Filed: May 18, 1992

Related U.S. Application Data

[63] Continuation of Ser. No. 572,299, Aug. 27, 1990, abandoned, which is a continuation of Ser. No. 343,231, Aug. 26, 1989, abandoned.

[51] Int. Cl.[5] ..... C11D 1/68; C11D 1/66; C11D 1/02

[52] U.S. Cl. ..... 252/550; 252/551; 252/552; 252/DIG. 1; 252/553; 252/174.21; 252/174.22; 252/DIG. 14

[58] Field of Search ..... 252/550, 551, 552, 553, 252/174.21, 174.22, DIG. 1, DIG. 14

[56] References Cited

U.S. PATENT DOCUMENTS

| | | | |
|---|---|---|---|
| 4,671,895 | 6/1987 | Erilli et al. | 252/552 |
| 4,692,271 | 9/1987 | Messenger et al. | 252/354 |
| 4,732,707 | 3/1988 | Naik et al. | 252/548 |
| 4,734,233 | 3/1988 | Winterbotham | 252/548 |
| 4,753,754 | 6/1988 | Messenger et al. | 252/354 |
| 4,862,632 | 5/1989 | Blackburn et al. | 252/550 |
| 4,923,636 | 5/1990 | Blackburn et al. | 252/550 |

*Primary Examiner*—Paul Lieberman
*Assistant Examiner*—Kery A. Fries
*Attorney, Agent, or Firm*—Pamela J. McCollough

[57] ABSTRACT

This invention relates to a liquid surface active composition which comprises: a) from about 28 percent by weight to about 66 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having in the range of from about 8 to about 12 carbon atoms, and n represents the average number of oxyethylene groups per molecule and is a number in the range of from about 1 to about 12, b) from about 28 percent by weight to about 66 percent by weight of a salt of an alcohol ethoxysulfate having a formula $R'—O—(CH_2CH_2O)_x—SO_3M$, wherein R' is an alkyl group having from about 8 to about 18 carbon atoms or an alkylaryl group having an alkyl moiety having from about 8 to about 12 carbon atoms, M is a cation selected from an alkali metal ion, an ammonium ion and mixtures thereof, and x represents the average number of oxyethylene groups per molecule and is a number in the range of from about 1 to about 12, and c) from about 0.01 percent by weight to about 15 percent by weight water, wherein components (a) and (b) comprise at least about 85 percent by weight of said composition and the weight ratio of component (a) to component (b) is in the range of from about 2:1 to about 1:2, and wherein said composition is substantially free of an organic solvent.

24 Claims, No Drawings

HIGHLY CONCENTRATED LIQUID SURFACE ACTIVE COMPOSITIONS CONTAINING ALCOHOL ETHOXYLATE AND ALCOHOL ETHOXYSULFATE

This is a continuation of application Ser. No. 572,299 filed Aug. 27, 1990, which is a continuation of application Ser. No. 343,231, filed Aug. 26, 1989, both now abandoned.

FIELD OF THE INVENTION

This invention relates to liquid surface active compositions of high active matter content comprising a mixture of alcohol ethoxylates and alcohol ethoxysulfates.

BACKGROUND OF THE INVENTION

The manufacture and use of synthetic laundry detergents containing mixtures of nonionic and anionic surfactants have been documented in the patent literature.

Liquid surfactant compositions are well known in the field of laundry detergents and, whether for domestic or industrial applications, practically all of the available formulations are solutions of one or more surface active materials (surfactants) in water, together with an organic solvent if necessary. Such formulations usually contain only about 10 wt % to 45 wt % active matter.

There are certain problems involved in the use of relatively dilute formulations such as the difficulty and high cost of transporting the formulation from its point of manufacture to its point of sale. Since most of the formulation's bulk is water, it would be very advantageous from the standpoint of shipping costs to prepare more concentrated formulations.

By providing good detergency and foamability, alcohol ethoxysulfates are finding increasing use in household laundry powders and liquids as part of mixed active surfactant systems. However, a drawback to the use of alcohol ethoxysulfates in formulations is their strong gel forming tendencies as they are diluted into formulations having concentrations greater than 30%. Gel formation can be reduced by incorporating approximately 14% ethanol into 60% active matter solutions of alcohol ethoxysulfates. This relatively high active matter solution lowers shipping costs, but the presence of ethanol in alcohol ethoxysulfate solutions prevents their use in spray-dried or dry-blended laundry powders where the flammability and combustibility of ethanol are a significant processing hazard. In addition, excessive water prohibits the formation of a free-flowing powder when surfactant concentrates are blended with water-soluble detergent powder particles.

It is therefore an object of this invention to prepare surface active compositions comprising a blend of alcohol ethoxylates and alcohol ethoxysulfates with less than about 15% water and substantially free of any organic solvent. In the surfactant compositions of the present invention, an anionic surfactant, alcohol ethoxysulfate, is blended with a nonionic surfactant, alcohol ethoxylate, where each of these surfactant types act as mutual hydrotropes, thereby permitting liquid concentrates containing active matter levels of at least about 85%. It is a further object of this invention to provide concentrates which are clear, single-phase pourable liquids rather than gels at relatively low temperatures such as, for example, about 50° C. or less.

SUMMARY OF THE INVENTION

This invention relates to a liquid surface active composition which comprises: a) from about 28 percent by weight to about 66 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having from about 8 to about 12 carbon atoms, and n represents the average number of oxyethylene groups per molecule and is a number in the range of from about 1 to about 12, b) from about 28 percent by weight to about 66 percent by weight of a salt of an alcohol ethoxysulfate having a formula $R'—O—(CH_2CH_2O)_xSO_3M$, wherein R' is an alkyl group having from about 8 to about 18 carbon atoms or an alkylaryl group having an alkyl moiety having from about 8 to about 12 carbon atoms, M is a cation selection from an alkali metal ion, an ammonium ion and mixtures thereof, and x represents the average number of oxyethylene groups per molecule and is a number in the range of from about 1 to about 12, and c) from about 0.01 percent by weight to about 15 percent by weight water, wherein components (a) and (b) comprise at least about 85 percent by weight of said composition and wherein said composition is substantially free of any organic solvent.

This invention also relates to powder detergent compositions prepared utilizing these surfactant compositions and processes for preparing them.

DESCRIPTION OF THE PREFERRED EMBODIMENTS

This invention relates to a single-phase liquid surface active composition comprising a) an alcohol ethoxylate component, b) an alcohol ethoxysulfate component and c) less than about 15 percent by weight of water, wherein components (a) and (b) together comprise at least about 85 percent by weight of the composition. The composition is also substantially free of organic solvents, particularly low molecular weight organic solvents and more particularly, lower alcohols having from 1 to about 5 carbon atoms, particularly ethanol and methanol.

As used herein, the term "liquid" shall mean a pourable material which is neither a solid nor a gel. As used herein, "substantially free" of an organic solvent shall mean that the amount of organic present, if any, is less than the amount which would substantially alter the properties of the composition. The composition typically contains less than about 3 percent by weight of organic solvent, per total weight of the composition.

The general class of nonionic surfactants or alcohol ethoxylates of relevance to the invention is characterized by the chemical formula $$R—O—(CH_2CH_2O)_n—H \quad (I)$$

wherein R is a straight-chain or branched-chain alkyl group having in the range of from about 8 to about 18 carbon atoms, preferably from about 12 to about 18 carbon atoms, or an alkylaryl group having an alkyl moiety having from about 8 to about 12 carbon atoms, and n represents the average number of oxyethylene groups per molecule and is in the range of from about 1 to about 12, preferably from about 2 to about 9 and more preferably from about 2 to about 5. The alkyl group can have a carbon chain which is straight or branched, and the ethoxylate component can be a combination of straight-chain and branched molecules. Preferably, about 85 percent of the R groups in the instant composition are straight-chain. It is understood that R can be substituted with any substituent which is inert such as, for example, halo groups. Ethoxylates within this class are conventionally prepared by the sequential addition of ethylene oxide to the corresponding alcohol (ROH) in the presence of a catalyst.

The alcohol ethoxylate component of this invention is preferably derived by ethoxylation of primary or secondary, straight-chain or branched alcohols. Suitably, the alcohols have from about 8 to about 18 carbon atoms, preferably from about 9 to about 15 carbon atoms, and more preferably from about 12 to about 15 carbon atoms. The most common ethoxylates in this class and the ones which are particularly useful in this invention are the primary alcohol ethoxylates, i.e., compounds of formula I in which R is an alkyl group and the $—O—(CH_2—CH_2O)_n—H$ ether substituent is bound to a primary carbon of the alkyl group.

Alcohols which are suitable for ethoxylation to form the alcohol ethoxylate component of this invention include coconut fatty alcohols, tallow fatty alcohols, and the commercially available synthetic long-chain fatty alcohol blends, e.g., the $C_{12}$ to $C_{15}$ alcohol blends available as NEODOL 25 Alcohol (a registered trademark of product manufactured and sold by Shell Chemical Company), the $C_{12}$ to $C_{14}$ alcohol blends available as Tergitol 24L (a registered trademark of product manufactured and sold by Union Carbide Corporation), and the $C_{12}$ to $C_{13}$ alcohol blends available, for example, as NEODOL 23 Alcohol (Shell).

Suitable alcohol ethoxylates can be prepared by adding to the alcohol or mixture of alcohols to be ethoxylated a calculated amount, e.g., from about 0.1 percent by weight to about 0.6 percent by weight, preferably from about 0.1 percent by weight to about 0.4 percent by weight, based on total alcohol, of a strong base, typically an alkali metal or alkaline earth metal hydroxide such as sodium hydroxide or potassium hydroxide, which serves as a catalyst for ethoxylation. The resulting mixture is dried, as by vapor phase removal of any water present, and an amount of ethylene oxide calculated to provide from about 1 mole to about 12 moles of ethylene oxide per mole of alcohol is then introduced and the resulting mixture is allowed to react until the ethylene oxide is consumed, the course of the reaction being followed by the decrease in reaction pressure.

The ethoxylation is typically conducted at elevated temperatures and pressures. Suitable reaction temperatures range from about 120° C. to about 220° C. with the range of from about 140° C. to about 160° C. being preferred. A suitable reaction pressure is achieved by introducing to the reaction vessel the required amount of ethylene oxide which has a high vapor pressure at the desired reaction temperature. For consideration of process safety, the partial pressure of the ethylene oxide reactant is preferably limited, for instance, to less than about 60 psia, and/or the reactant is preferably diluted with an inert gas such as nitrogen, for instance, to a vapor phase concentration of about 50 percent or less. The reaction can, however, be safely accomplished at greater ethylene oxide concentration, greater total pressure and greater partial pressure of ethylene oxide if suitable precautions, known to the art, are taken to manage the risks of explosion. A total pressure of between about 40 and 110 psig, with an ethylene oxide partial pressure between about 15 and 60 psig, is particularly preferred, while a total pressure of between about 50 and 90 psig, with an ethylene oxide partial pressure between about 20 and 50 psig, is considered more preferred. The pressure serves as a measure of the degree of the reaction and the reaction is considered to be substantially complete when the pressure no longer decreases with time.

It should be understood that the ethoxylation procedure serves to introduce a desired average number of ethylene oxide units per mole of alcohol ethoxylate. For example, treatment of an alcohol mixture with 3 moles of ethylene oxide per mole of alcohol serves to effect the ethoxylation of each alcohol molecule with an average of 3 ethylene oxide moieties per mole alcohol moiety, although a substantial proportion of alcohol moieties will become combined with more than 3 ethylene oxide moieties and an approximately equal proportion will have become combined with less than 3. In a typical ethoxylation product mixture, there is also a minor proportion of unreacted alcohol.

Specific nonionic detergent active compounds which can be used in the composition of the present invention include ethoxylated fatty alcohols, preferably linear primary or secondary monohydric alcohols with about $C_8$ to about $C_{18}$, preferably about $C_{12}$ to about $C_{15}$, alkyl groups and an average of about 1 to about 12, preferably about 2 to about 9, moles of ethylene oxide per mole of alcohol, and ethoxylated alkylphenols with $C_8$ to about $C_{12}$ alkyl groups, preferably about $C_8$ to about $C_{10}$ alkyl groups and an average of about 1 to about 12 moles of ethylene oxide per mole of alkylphenol.

A preferred class of nonionic ethoxylates is represented by the condensation product of a fatty alcohol having from about 12 to about 15 carbon atoms and from about 2 to about 9 moles of ethylene oxide per mole of fatty alcohol. Suitable species of this class of ethoxylates include: the condensation product of $C_{12}$–$C_{15}$ oxo-alcohols and 7 moles of ethylene oxide; the condensation product of narrow cut $C_{14}$–$C_{15}$ oxo-alcohols and 7 or 9 moles of ethylene oxide per mole of fatty (oxo)alcohol; the condensation of a narrow cut $C_{12}$–$C_{13}$ fatty (oxo)alcohol and 6.5 moles of ethylene oxide per mole of fatty alcohol. The fatty oxo-alcohols, while primarily linear, can have, depending upon the processing conditions and raw material olefins, a certain degree of branching. A degree of branching in the range from 15% to 50% by weight is frequently found in commercially available oxo-alcohols.

The amount of alcohol ethoxylate present in the composition of the present invention may range from about 28 percent by weight to about 66 percent by weight, and preferably from about 40 percent by weight to about 60 percent by weight.

The general class of anionic surfactants or alcohol ethoxysulfates or relevance to component (b) of the composition is characterized by the chemical formula $$R'—O—CH_2—CH_2O)_x—SO_3M \quad \text{(II)}$$

wherein R' is a straight-chain or branched-chain alkyl group having in the range of from about 8 to about 18 carbon atoms, preferably from about 12 to about 18 carbon atoms, or an alkylaryl group having an alkyl moiety having from about 8 to about 12 carbon atoms, x represents the average number of oxyethylene groups per molecule and is in the range of from about 1 to about 12, preferably from about 5 to about 12 and more preferably from about 9 to about 12 and M is a cation selected from an alkali metal ion, an ammonium ion, and mixtures thereof. R' is preferably substantially straight-chain alkyl, that is, at least about 50 percent, preferably about 85 percent, of the alkyl R' groups in the instant composition are straight-chain. It is understood that R' can be substituted with any substituent which is inert such as, for example, halo groups.

In one embodiment, the alcohol ethoxysulfates are derivatives of primary or secondary alcohols of carbon number ranging from about 8 to about 18. The alcohol precursors of the alcohol ethoxysulfate are straight-chain alcohols or are of a branched-chain structure. The alcohol precursors utilized to make the alcohol ethoxysulfate component preferably have from about 8 to about 15 carbon atoms, and more preferably, from about 12 to about 15 carbon atoms. Alcohols which are suitable for ethoxylation to form an alcohol ethoxylate which can then be subjected to a sulfation procedure to form the alcohol ethoxysulfate component of the composition include coconut fatty alcohols, tallow fatty alcohols, and the commercially available long-chain synthetic fatty alcohol blends, e.g., the $C_{12}$ to $C_{15}$ alcohol blends available as NEODOL 25 Alcohol (Shell Chemical Company), the $C_{12}$ to $C_{14}$ alcohol blends available as Tergitol 24L (Union Carbide Corporation), and the $C_{12}$ to $C_{13}$ alcohol blends available, for example, as NEODOL 23 Alcohol (Shell).

The alcohol ethoxysulfate component is typically prepared by first reacting the alcohol with about 1 to about 12 moles of ethylene oxide per mole of alcohol to form an alcohol ethoxylate product. Thereafter, these alcohol ethoxylate products are sulfated with a suitable sulfating reagent, and the resulting sulfated product mixture is neutralized with an aqueous alkali metal solution.

Suitable sulfation procedures include sulfur trioxide ($SO_3$) sulfation, chlorosulfonic acid ($ClSO_3H$) sulfation and sulfamic acid ($NH_2SO_3H$) sulfation, with sulfur trioxide sulfation being preferred. A typical sulfur trioxide sulfation procedure includes contacting liquid alcohol ethoxylate and gaseous sulfur trioxide at about atmospheric pressure in the reaction zone of a falling film sulfator cooled by water at a temperature in the range of from about 25° C. to about 70° C. to yield the sulfuric acid ester of alcohol ethoxylate. The sulfuric acid ester of the alcohol ethoxylate then exits the falling film column and is neutralized with ana alkali metal solution, e.g, sodium or potassium hydroxide, to form the alcohol ethoxysulfate salt.

Specific sulfated ethoxylated detergent active compounds which can be used in the composition of the present invention include sulfated ethoxylated fatty alcohols, preferably linear primary or secondary alcohols with about $C_8$ to about $C_{18}$, preferably about $C_{12}$ to about $C_{15}$, alkyl groups and an average of about 1 to about 12, preferably about 5 to about 12, moles of ethylene oxide per mole of alcohol, and sulfated ethoxylated alkylphenols with $C_8$ to about $C_{12}$ alkyl groups, preferably about $C_8$ to about $C_{10}$ alkyl groups and an average of about 1 to about 12 moles of ethylene oxide per mole of alkylphenol. The preferred class of alcohol ethoxysulfates are the sulfated linear alcohols, such as the $C_{12}$ to about $C_{15}$ alcohols ethoxylated with an average of from about 5 to about 12 moles of ethylene oxide. A most preferred alcohol ethoxysulfate is prepared by sulfating a $C_{12}$–$C_{13}$ alcohol ethoxylate with 6.5 moles of ethylene oxide.

In a preferred embodiment, the alcohol ethoxysulfate component has a higher average number of oxyethylene units per molecule than the alcohol ethoxylate component. The average number of oxyethylene units per molecule in the alcohol ethoxysulfate component is typically in the range of from about 1 to about 12, preferably from about 5 to about 12, and more preferably from about 9 to about 12, and the average number of oxyethylene units per molecule in the alcohol ethoxylate component is typically in the range of from about 1 to about 12, preferably from about 2 to about 9, and more preferably from about 2 to about 5.

The amount of alcohol ethoxysulfate present in the composition is in the range of from about 28 percent by weight to about 66 percent by weight, and preferably from about 40 percent by weight to about 60 percent by weight.

The weight ratio of component (a), alcohol ethoxylate, to component (b), alcohol ethoxysulfate, is in the range of from about 2:1 to about 1:2.

Component (c) of the liquid surface active composition is water. The amount of water utilized in the composition is less than about 15 percent by weight of the composition, preferably less than about 10 percent by weight, more preferably less than about 7 percent by weight, and most preferably, less than about 5 percent by weight. The amount of water can be controlled most efficiently when an anhydrous base, such as for example, triethanolamine or monoethanoline, is used as the neutralizing agent. However, through drying or through addition of water, the amount of water can also be controlled in systems prepared with alkali metal neutralizing agents. The desired amount of water can be readily determined by one of ordinary skill in the art with a minimal amount of routine experimentation.

The preparation of the liquid surface active compositions of the invention can be accomplished by mixing the components together in any manner. It is generally preferred, however, that the unneutralized alcohol ethoxysulfate product (i.e., the organic sulfuric acid ester resulting from the sulfation reaction) be added to a well-stirred mixture of alcohol ethoxylate and a concentrated base such as, for example, aqueous 50% sodium hydroxide. Other suitable bases include potassium hydroxide, ammonium hydroxide, triethanolamine and monoethanolamine.

Typically, the liquid compositions of the invention have a surface active material content, i.e. the percentage of alcohol ethoxylate plus the percentage of alcohol ethoxysulfate, of at least about 85 percent by weight, preferably at least about 90 percent by weight, and more preferably, at least about 95 percent by weight of said composition. The compositions are also substantially free, typically less than about 3 percent by weight, of organic solvents, preferably alcoholic solvents and more preferably, lower alcoholic solvents having from 1 to about 5 carbon atoms.

The liquid surfactant compositions of the invention can be utilized in a variety of detergent applications. The liquid surfactant compositions can be adsorbed at relatively low temperatures, about 60° C. or less, onto solid detergent materials such as, for example, sodium carbonate, in order to form dry detergent powders. The liquid surfactant composition can also be added to water to form liquid detergents having lower active matter concentrations.

The ranges and limitations provided in the instant specification and claims are those which are believed to particularly point out and distinctly claim the present invention. It is, however, understood that other ranges and limitations which perform substantially the same function in substantially the same manner to obtain the same or substantially the same result are intended to be within the scope of the instant invention as defined by the instant specification and claims.

The invention will be described below by the following examples which are provided for purposes of illustration and are not to be construed as limiting the invention.

Illustrative Embodiments

Preparation of Surfactant Compositions

Surfactant Composition A

An alcohol ethoxylate with a $C_{12}$–$C_{13}$ alkyl group and containing an average of 6.5 moles ethylene oxide/mole alcohol (commercially available as NEODOL 23-6.5 Alcohol) was sulfated by reaction with gaseous $SO_3$ in a lab-scale falling-film reactor to form an alcohol ethoxysulfate. The $SO_3$/ethoxylate molar ratio was 1.05, and the reactor temperature was 65° C. The acid product was prepared at a rate of 8 g/min and was directly neutralized in a pre-mixed solution containing 16.1 g aqueous 50% sodium hydroxide and 100 g of an alcohol ethoxylate with a $C_{12}$–$C_{13}$ alkyl group and containing an average of 5 moles ethylene oxide/mole alcohol (commercially available as NEODOL 23-5 Alcohol). The surfactant mixture was kept well-stirred through the use of a magnetic stirring plate, the temperature of the mixture being maintained at 55° C. with an external water bath. No gel formation was observed throughout the process. Approximately 100 g of acid product from the sulfator were added until pH 8 was obtained as measured by moistened pH paper.

The final product was a clear flowable liquid at 20° C. and had the following analyzed composition:

48% wt Alcohol Ethoxysulfate (Sodium Salt)
46% wt Alcohol Ethoxylate
5% wt Water
1% Sodium Sulfate and trace by-products A viscosity of 2 poise was measured for Surfactant Composition A at 50° C. and at a shear rate of 0.42 $sec^{-1}$ using a Brookfield Model LVTD viscometer.

Table I shows a comparison of the viscosity of Surfactant Composition A with the viscosity of an alcohol ethoxylate/water composition which contains the same amount of alcohol ethoxylate as Surfactant Composition A with the remainder of the composition being water and the viscosity of an alcohol ethoxysulfate/water composition which contains the same amount of alcohol ethoxysulfate as Surfactant Composition A with the remainder of the composition being water. As can be seen in Table I, the viscosity of Surfactant Composition A, which contains 94 percent by weight total surfactant, is substantially lower than the viscosity of both the alcohol ethoxylate/water composition and the alcohol ethoxysulfate/water composition.

TABLE I

| | Percent Weight Alcohol Ethoxylate | Percent Weight Alcohol Ethoxysulfate | Percent Weight $H_2O$ | Viscosity (poise) |
|---|---|---|---|---|
| Surfactant Composition A | 46 | 48 | 5 | 2 |
| Alcohol Ethoxylate/$H_2O$ | 46 | 0 | 54 | >400 |

TABLE I-continued

| | Percent Weight Alcohol Ethoxylate | Percent Weight Alcohol Ethoxysulfate | Percent Weight $H_2O$ | Viscosity (poise) |
|---|---|---|---|---|
| Surfactant Composition | | | | |
| Alcohol Ethoxysulfate/$H_2O$ Surfactant Composition | 0 | 48 | 52 | >400 |

Surfactant Composition B

Ten g of Surfactant Composition A were mixed with 4.1 g of NEODOL 23-5 Alcohol to produce a liquid which was clear and flowable at 20° C. and which had the following composition:

34% wt Alcohol Ethoxysulfate (Sodium Salt)
62% wt Alcohol Ethoxylate
3% wt Water
<1% Sodium Sulfate and trace by-products A viscosity of 1 poise was measured for the composition at 50° C. and 0.42 $sec^{-1}$.

Table II shows a comparison of the viscosity of Surfactant Composition B with the viscosity of an alcohol ethoxylate/water composition which contains the same amount of alcohol ethoxylate as Surfactant Composition B with the remainder of the composition being water and the viscosity of an alcohol ethoxysulfate/water composition which contains the same amount of alcohol ethoxysulfate as Surfactant Composition B with the remainder of the composition being water. As can be seen in Table II, the viscosity of Surfactant Composition B, which contains 96 percent by weight total surfactant, is substantially lower than the viscosity of both the alcohol ethoxylate/water composition and the alcohol ethoxysulfate/water composition.

TABLE II

| | Percent Weight Alcohol Ethoxylate | Percent Weight Alcohol Ethoxysulfate | Percent Weight $H_2O$ | Viscosity (poise) |
|---|---|---|---|---|
| Surfactant Composition B | 62 | 34 | 3 | 1 |
| Alcohol Ethoxylate/$H_2O$ Surfactant Composition | 62 | 0 | 38 | 310 |
| Alcohol Ethoxysulfate/$H_2O$ Surfactant Composition | 0 | 34 | 66 | >400 |

Surfactant Composition C

The procedure described for Surfactant Composition A was used except that 145 g of the acid form of the alcohol ethoxysulfate were neutralized in a pre-mixed solution containing 24 g aqueous 50% sodium hydroxide and 50 g NEODOL 23-5 Alcohol. Twenty g of the product were then blended with 0.7 g of additional NEODOL 23-5 Alcohol to prepare a composition which was a clear flowable liquid at 35° C. and above and which had the following composition:

61% wt Alcohol Ethoxysulfate (Sodium Salt)
32% wt Alcohol Ethoxylate
6% wt Water
1% Sodium Sulfate and trace by-products A viscosity of 7 poise was measured for the composition at 50° C. and 0.42 $sec^{-1}$.

Table III shows a comparison of the viscosity of Surfactant Composition C with the viscosity of an alcohol ethoxylate/water composition which contains the same amount of alcohol ethoxylate as Surfactant Composition C with the remainder of the composition being water and the viscosity of an alcohol ethoxysulfate/water composition which contains the same amount of alcohol ethoxysulfate as Surfactant Composition C with the remainder of the composition being water. As can be seen in Table III, the viscosity of Surfactant Composition C, which contains 93 percent by weight total surfactant, is substantially lower than the viscosity of both the alcohol ethoxylate/water composition and the alcohol ethoxysulfate/water composition.

TABLE III

| | Percent Weight Alcohol Ethoxylate | Percent Weight Alcohol Ethoxysulfate | Percent Weight $H_2O$ | Viscosity (poise) |
|---|---|---|---|---|
| Surfactant Composition C | 32 | 61 | 6 | 7 |
| Alcohol Ethoxylate/$H_2O$ Surfactant Composition | 32 | 0 | 68 | 230 |
| Alcohol Ethoxysulfate/$H_2O$ Surfactant Composition | 0 | 61 | 39 | >400 |

Preparation of Detergent Compositions

Detergent Composition 1

Thirty-four grams of the neutralized Surfactant Composition A were heated to 50° C. and added at a rate of 2.2 cc/min to 125 g of a low-density 2/1 (by wt) sodium bicarbonate/carbonate mixture. During the surfactant addition, the powder was stirred in a Brabender Viscosimeter Model VC-3 at 100 RPM using a double flag sensor. A free-flowing, non-lumpy powder was obtained. The powder flow properties were evaluated using a standard funnel flow test in which the time required for 50 g of the powder sample to flow through a test funnel is measured. An average mass flow rate can then be calculated. In this test, which simulates flow through a small orifice of the type found on laundry detergent containers, typical commercial laundry powders exhibit average flow rates between 5 g/sec and 9 g/sec, with the higher flow rates representing the more desirable behavior.

After an aging time of one week, Detergent Composition 1 exhibited an average flow rate of 6.3 g/sec thereby falling in the mid-range of the commercial products. By comparison, a powder prepared in the same manner but containing 35 g of NEODOL 23-5 Alcohol as the sole surfactant exhibited a flow rate of 5.4 g/sec while a powder prepared with an excessive quantity of NEODOL 23-5 Alcohol (67 g) would not flow through the funnel.

The cleaning properties of Detergent Composition 1 were evaluated using a standard radiolabeled soils' detergency testing procedure which is described in numerous technical articles, e.g. *Chemical Times & Trends*, Vol. 8, p. 31, and *Journal of the American Oil Chemists' Society*, Vol. 46, p. 537. The total concentration of Detergent Composition 2 was 0.07% by weight, the wash temperature was 38° C., and the water hardness was 150 ppm as calcium carbonate (Ca/Mg=3/2 on molar basis). The following results were obtained for removal of various soils from permanent press 65/35 polyester/cotton fabric.

| Soil | % Soil Removal |
|---|---|
| Mineral Oil | 30 |
| Synthetic Sebum | 49 |
| Clay | 32 |

In the same test, commercial detergents used at the same concentration yield comparable removal levels.

Detergent Composition 2

The procedure described for Detergent Composition 1 was used except that 32 g of Surfactant Composition A were added to a powder blend containing 32 g of the sodium bicarbonate/carbonate mixture and 93 g of a light density sodium tripolyphosphate powder. The resulting detergent powder had an average flow rate of 5.0 g/sec in the standard funnel flow test after one week aging. Also, the following soil removal levels were found for the detergent composition using the procedure and conditions described above for Detergent Composition 1:

| Soil | % Soil Removal |
|---|---|
| Mineral Oil | 28 |
| Synthetic Sebum | 60 |
| Clay | 34 |

What is claimed is:

1. A liquid surface active composition which comprises: a) from about 28 percent by weight to about 50 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having from about 8 to about 12 carbon atoms, and n represents the average number of oxyethylene groups per molecule and is a number in the range of from about 1 to about 12, b) from about 28 percent by weight to about 66 percent by weight of a salt of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having in the range of from about 8 to about 12 carbon atoms, M is a cation selected from the group consisting of an alkali metal ion, an ammonium ion and mixtures thereof, and x represents the average number of oxyethylene groups per molecule and is a number in the range of from about 1 to about 12, and c) from about 0.01 percent by weight to about 15 percent by weight water, wherein the percent by weight of component (b) is in excess of the percent by weight of component (a), wherein components (a) and (b) comprise at least about 85 percent by weight of said composition and wherein the weight ratio of component (b) to component (a) is in the range of from about 2:1 to greater than about 1:1.

2. A liquid surface active composition which comprises: a) from about 28 percent by weight to about 50 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having from about 8 to about 12 carbon atoms, and n represents the average number of oxyethylene groups per molecule and is a number in the range of from about 1 to about 12, b) from about 28 percent by weight to about 66 percent by weight of a salt of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having from about 8 to about 12 carbon atoms, M is a cation selected from the group consisting of an alkali metal ion, an ammonium ion and mixtures thereof, and x represents the average number of oxyethylene groups per molecule and is a number in the range of from about 1 to about 12, and c) from about 0.01 percent by weight to about 10 percent by weight water, wherein the percent by weight of component (b) is in excess of the percent by weight of component (a), wherein components (a) and (b) comprise at least about 90 percent by weight of said composition and wherein the weight ratio of component (b) to component (a) is in the range of from about 2:1 to greater than about 1:1.

3. The composition of claims 1 or 2 wherein said composition is substantially free of organic solvents.

4. The composition of claims 1 or 2 wherein said composition is substantially free of lower alcohol solvents.

5. The composition of claims 1 or 2 wherein said composition is substantially free of $C_1$ to about $C_5$ alcohol solvents.

6. A dry, powdered detergent composition comprising a liquid surface active composition which comprises: a) from about 28 percent by weight to about 50 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having from about 8 to about 12 carbon atoms, and n represents the average number of oxyethylene groups per molecule and is a number in the range of from about 1 to about 12, b) from about 28 percent by weight to about 66 percent by weight of a salt of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having in the range of from about 8 to about 12 carbon atoms, M is a cation selected from the group consisting of an alkali metal ion, an ammonium ion and mixtures thereof, and x represents the average number of oxyethylene groups per molecule and is a number in the range of from about 1 to about 12, and c) from about 0.01 percent by weight to about 15 percent by weight water, wherein the percent by weight of component (b) is in excess of the percent by weight of component (a), wherein components (a) and (b) comprise at least about 85 percent by weight of said liquid surface active composition and wherein the weight ratio of component (b) to component (a) is in the range of from about 2:1 to greater than about 1:1, and adsorbent powder detergent ingredients.

7. A dry, powdered detergent composition comprising a liquid surface active composition which comprises: a) from about 28 percent by weight to about 66 percent by weight of an alcohol ethoxylate having a formula $R—O—(CH_2CH_2O)_n—H$, wherein R is an alkyl group having from about 8 to about 18 carbon atoms or an alkylaryl group having an alkyl moiety having from about 8 to about 12 carbon atoms, and n represents the average number of oxyethylene groups per molecule and is a number in the range of from about 1 to about 12, b) from about 28 percent by weight to about 50 percent by weight of a salt of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having from about 8 to about 12 carbon atoms, M is a cation selected from the group consisting of an alkali metal ion, an ammonium ion and mixtures thereof, and x represents the average number of oxyethylene groups per molecule and is a number in the range of from about 1 to about 12, and c) from about 0.01 percent by weight to about 10 percent by weight water, wherein the percent by weight of component (b) is in excess of the percent by weight of component (a), wherein components (a) and (b) comprise at least about 90 percent by weight of said liquid surface active composition and wherein the weight ratio of component (b) to component (a) is in the range of from about 2:1 to greater than about 1:1, and adsorbent powder detergent ingredients.

8. The composition of claims 6 or 7 wherein said liquid surface active composition is substantially free of organic solvents.

9. The composition of claims 6 or 7 wherein said liquid surface active composition is substantially free of lower alcohol solvents.

10. The composition of claims 6 or 7 wherein said liquid surface active composition is substantially free of $C_1$ to about $C_5$ alcohol solvents.

11. A process for preparing a dry, powdered detergent composition of which comprises mixing a liquid surface active composition comprising a) from about 28 percent by weight to about 50 percent by weight of an alcohol ethoxylate, b) from about 28 percent by weight to about 66 percent by weight of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having in the range of from about 8 to about 12 carbon atoms, M is a salt selected from the group consisting of an alkali metal salt, an ammonium salt and mixtures thereof, and x represents the average number of oxyethylene groups per molecule and is a number in the range of from about 1 to about 12, and c) from about 0.01 percent by weight to about 15 percent by weight water, wherein the percent by weight of component (b) in said liquid surface active composition is in excess of the percent by weight of component (a), wherein components (a) and (b) comprise at least about 85% by weight of said liquid composition and wherein the weight ratio of component (b) to component (a) is in the range of from about 2:1 to greater than about 1:1, which is prepared by adding a sulfuric acid ester of an alcohol ethoxylate to a mixture of alcohol ethoxylate and a concentrated base selected from the group consisting of sodium hydroxide, potassium hydroxide, ammonium hydroxide, triethanolamine, monoethanolamine and mixtures thereof, with adsorbent powder detergent ingredients.

12. A process for preparing a dry, powdered detergent composition of which comprises mixing a liquid surface active composition comprising a) from about 28 percent by weight to about 50 percent by weight of an alcohol ethoxylate, b) from about 28 percent by weight to about 66 percent by weight of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having an alkyl moiety having in the range of from about 8 to about 12 carbon atoms, M is a salt selected from the group consisting of an alkali metal salt, an ammonium salt and mixtures thereof, and x represents the average number of oxyethylene groups per molecule and is a number in the range of from about 1 to about 12, and c) from about 0.1 percent by weight to about 10 percent by weight water, wherein the percent by weight of component (b) in said liquid surface active composition is in excess of the percent by weight of component (a), wherein components (a) and (b) comprise at least about 90% by weight of said liquid composition and wherein the weight ratio of component (b) to component (a) is in the range of from about 2:1 to greater than about 1:1, which is prepared by adding a sulfuric acid ester of an alcohol ethoxylate to a mixture of alcohol ethoxylate and a concentrated base selected from the group consisting of sodium hydroxide, potassium hydroxide, ammonium hydroxide, triethanolamine, monoethanolamine and mixtures thereof, with adsorbent powder detergent ingredients.

13. The process of claims 11 or 12 wherein said process is carried out at a temperature in the range of from about 20° C. to about 80° C. and at about atmospheric pressure.

14. The process of claims 11 or 12 wherein said alcohol ethoxylate in said liquid surface active composition has a formula $R—O—(CH_2CH_2O)_n—H$, wherein R is an alkyl group having from about 8 to about 18 carbon atoms or an alkylaryl group having an alkyl moiety having in the range of from about 8 to about 12 carbon atoms, and n represents the average number of oxyethylene groups per molecule and is a number in the range of from about 1 to about 12.

15. The process of claims 11 or 12 wherein said liquid surface active composition is substantially free of organic solvents.

16. The process of claims 11 or 12 wherein said liquid surface active composition is substantially free of lower alcohol solvents.

17. The process of claims 11 or 12 wherein said liquid surface active composition is substantially free of $C_1$ to about $C_5$ alcohol solvents.

18. A process for preparing a liquid surface active composition comprising: a) from about 28 percent by weight to about 50 percent by weight of an alcohol ethoxylate, b) from about 28 percent by weight to about 66 percent by weight of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having in the range of from about 8 to about 12 carbon atoms, M is a salt selected from the group consisting of an alkali metal salt, an ammonium salt and mixtures thereof, and x represents the average number of oxyethylene groups per molecule and is a number in the range of from about 1 to about 12, and c) from about 0.1 percent by weight to about 15 percent by weight water, wherein the percent by weight of component (b) in said liquid surface active composition is in excess of the percent by weight of component (a), wherein components (a) and (b) comprise at least about 85% by weight of said composition and wherein the weight ratio of component (b) to component (a) is in the range of from about 2:1 to greater than about 1:1, which process comprises adding a sulfuric acid ester of an alcohol ethoxylate to a mixture of alcohol ethoxylate and a concentrated base selected from the group consisting of sodium hydroxide, potassium hydroxide, ammonium hydroxide, triethanolamine, monoethanolamine and mixtures thereof.

19. A process for preparing a liquid surface active composition comprising: a) from about 28 percent by weight to about 50 percent by weight of an alcohol ethoxylate, b) from about 28 percent by weight to about 66 percent by weight of an alcohol ethoxysulfate having a formula $R'—O—(CH_2CH_2O)_x—SO_3M$, wherein R' is a substantially straight-chain alkyl group having from about 8 to about 18 carbon atoms or an alkylaryl group having in the range of from about 8 to about 12 carbon atoms, M is a salt selected from the group consisting of an alkali metal salt, an ammonium salt and mixtures thereof, and x represents the average number of oxyethylene groups per molecule and is a number in the range of from about 1 to about 12, and c) from about 0.1 percent by weight to about 10 percent by weight water, wherein the percent by weight of component (b) in said liquid surface active composition is in excess of the percent by weight of component (a), wherein components (a) and (b) comprise at least about 90% by weight of said composition and wherein the weight ratio of component (b) to component (a) is in the range of from about 2:1 to greater than about 1:1, which process comprises adding a sulfuric acid ester of an alcohol ethoxylate to a mixture of alcohol ethoxylate and a concentrated base selected from the group consisting of sodium hydroxide, potassium hydroxide, ammonium hydroxide, triethanolamine, monoethanolamine and mixtures thereof.

20. The process of claims 18 or 19 wherein said process is carried out at a temperature in the range of from about 20° C. to about 80° C. and at about atmospheric pressure.

21. The process of claims 18 or 19 wherein said alcohol ethoxylate in said liquid surface active composition has a formula $R—O—(CH_2CH_2O)_n—H$, wherein R is an alkyl group having from about 8 to about 18 carbon atoms or an alkylaryl group having an alkyl moiety having in the range of from about 8 to about 12 carbon atoms, and n represents the average number of oxyethylene groups per molecule and is a number in the range of from about 1 to about 12.

22. The process of claims 18 or 19 wherein said liquid surface active composition is substantially free of organic solvents.

23. The process of claims 18 or 19 wherein said liquid surface active composition is substantially free of lower alcohol solvents.

24. The process of claims 18 or 19 wherein said liquid surface active composition is substantially free of $C_1$ to about $C_5$ alcohol solvents.

* * * * *